US008967063B2

(12) United States Patent
Coffman

(10) Patent No.: US 8,967,063 B2
(45) Date of Patent: Mar. 3, 2015

(54) SAILING MONOHULL TRI-FOILER

(75) Inventor: William Coffman, Ft. Lauderdale, FL (US)

(73) Assignee: CF Boats Intellectual Property Corp., Fort Lauderdale, FL (US)

( * ) Notice: Subject to any disclaimer, the term of this patent is extended or adjusted under 35 U.S.C. 154(b) by 555 days.

(21) Appl. No.: 12/764,953

(22) Filed: Apr. 22, 2010

(65) Prior Publication Data

US 2011/0259254 A1 Oct. 27, 2011

(51) Int. Cl.
*B63B 1/26* (2006.01)
*B63B 1/24* (2006.01)

(52) U.S. Cl.
CPC ..... *B63B 1/248* (2013.01)
USPC ..... 114/39.24; 114/280

(58) Field of Classification Search
USPC ..... 114/39.24, 274–282, 138, 141
See application file for complete search history.

(56) References Cited

U.S. PATENT DOCUMENTS

| | | | | | |
|---|---|---|---|---|---|
| 2,081,868 | A | * | 5/1937 | Hampden | 114/274 |
| 2,914,014 | A | * | 11/1959 | Carl et al. | 114/281 |
| 3,081,728 | A | * | 3/1963 | Wilterdink et al. | 114/282 |
| 3,259,093 | A | * | 7/1966 | Taylor | 114/282 |
| 5,054,410 | A | | 10/1991 | Scarborough | |
| 5,158,251 | A | * | 10/1992 | Taylor | 244/199.3 |
| 5,471,942 | A | | 12/1995 | Miller et al. | |
| 5,474,011 | A | * | 12/1995 | Steinberg | 114/282 |
| 6,499,419 | B1 | | 12/2002 | Bussard | |
| 7,520,238 | B2 | * | 4/2009 | Patterson | 114/274 |
| 7,984,684 | B2 | * | 7/2011 | Hinderks | 114/274 |

* cited by examiner

*Primary Examiner* — Edwin Swinehart
(74) *Attorney, Agent, or Firm* — Charles Gideon Korrell

(57) ABSTRACT

A tri-foil sailboat and powerboat are described having retractable hydrofoils with independently adjustable angles of attack allowing the hull to be fully lifted from the water and the sailboat to travel at more than twice the wind speed.

11 Claims, 7 Drawing Sheets

SAILING MONOHULL TRI-FOILER

FIELD OF THE INVENTION

The field of this invention relates to wind-powered and motor-powered water vessels, and more specifically to a monohull sailboat or powerboat having one or more hydrofoils.

BACKGROUND

Hydrofoil technology dates back to the late 1800's and was expanded upon in the 1950's. Consequently, there exist a wide variety of hydrofoils designed to lift the hull of a vessel out of the water when the vessel is moving in the forward direction. The purpose of hydrofoils has generally been to lift the hull of a vessel out of the water when at speed, known as being "foil-bound," minimizing the amount of surface area in contact with the water (the wetted surface area) and therefore minimizing drag and consequently increasing speed as well as fuel efficiency.

The operation of hydrofoils is generally known to those skilled in the art as operating under the same principles as an air foil: by moving a cambered foil through a liquid, a pressure differential is created, resulting in a lift force orthogonal to the direction of movement. In other words, as a cambered foil moves in the forward direction through a medium, a resultant upward or downward force is applied to the foil, depending on the shape of the camber.

Affixing hydrofoils to motor-powered vessels has generally been more popular than affixing hydrofoils to wind-powered vessels. Some reasons for this are that motor-driven propulsion provides (relatively) high speed, quick acceleration, and a single-direction, constant force. The foil designs may therefore be smaller and need only account for a single force vector—the motor-driven propeller.

As for wind-powered vessels, the wind speed and direction can often be unpredictable. Additionally, those skilled in the art are also aware that water vessels powered by wind are often subjected to a heeling moment. A heeling moment is a moment induced by the wind against the sailing rig causing the vessel to tilt or heel to one side. Such heeling makes it difficult for a vessel to be lifted out of the water by vertically-lifting hydrofoils fixed to the hull, as the lift is no longer vertically out of the water, but more in a sideways direction.

Some designs, as in U.S. Pat. No. 6,499,419 to Bussard, have attempted to extend the hydrofoils in several directions such that there is a portion of the foil that will provide vertical lift at certain angles of heel. Such "surface piercing" designs by necessity extend out beyond the hull of the vessel. The widening of the foils to accommodate for the heeling enlarges the vessel's footprint significantly and likely becomes difficult to handling. Such designs do little to counter the heeling moment, causing difficulty in controlling the vessel. In addition, it is generally known in the art that such surface piercing hydrofoils are not ideal in anything other than smooth water, as they are subject to the effects of wave action, resulting in an uncomfortable ride for the passengers.

Another problem caused by heel is a loss of power from the sailing rig. As the vessel and the attached sailing rig are blown by the wind, they tilt away from the wind. As a result, the effective surface area of the sail is reduced, thereby reducing the capability of the sailing rig to extract the maximum amount of power from the available wind. In non-hydrofoil sailing vessels, a keel is often used to counter this heeling moment and to maintain the vessel and sailing rig as vertical as possible. As a result, the effective surface area of the sail is increased and thereby the power derived from the wind. Keels, however, are necessarily heavy, increase the draft of the boat, and are not ideal for a vessel having hydrofoils that lift it out of the water.

One solution to avoid any heeling is to have another sort of counterweight force, as in the International Moth-class hydrofoil boat design and some windsurfer designs, such as U.S. Pat. No. 5,471,942 to Miller et al. In the case of a windsurfer, the passenger serves as the counterweight by holding onto the boom of the sailing rig (flexibly affixed to the board) and leaning away from the sail while in the case of the boat (having a mast rigidly affixed to the boat), the passenger (s) "hike-out" onto an extended deck/platform and are attached to a harness and trapeze. These designs typically have one forward and one aft t-foil that are used to provide the lift. Although fast, these designs are highly unstable and are highly reliant upon the weight and skill of the passenger(s) to serve as the counterweight and controllers. Significantly relying on such a counterweight tends to make operating the vessel difficult, uncomfortable, and generally limits the size/displacement of the vessel to an amount that would allow such counterweight to remain effective while foil-born.

Other designs have used sponsons, outriggers, or multiple hulls for a broader beam to counteract the heeling moment with buoyancy. Better known examples of these are, for example, trimarans such as the WindRider Rave, the Hobie Trifoiler, and the French-Swiss l'Hydroptère, which, for the purposes of this discussion, are sufficiently similar to U.S. Pat. No. 5,054,410 to Scarborough. In these multi-hull designs, the additional hulls serve the purpose of countering the moment induced by the wind onto the sailing rig. As a result, the vessel remains substantially upright with respect to the water surface. The hydrofoils that are employed in these designs may therefore be fully submerged. Although these designs cause the sail to remain fully upright (perpendicular to the water surface) and thereby maximizing the available wind, the wide beam, by design, creates a wide vessel, resulting in, for example, difficulty in storing, transporting, and navigating in narrow passages.

Sailing vessels with fixed hydrofoil designs in general are also limited from traveling in shallow water. Similar to sailboats with fixed keels, in such shallow water environments, the chances of running aground or hitting underwater structures such as a reef are increased. Challenges relating to the storage of a vessel having fixed hydrofoils are similar to those with a large beam.

Having adjustable hydrofoils in powerboats may also improve the stability and efficiency of the vessel in certain conditions, particularly during high-speed turns when the centrifugal forces tends to cause the vessel to tip to the outside of the turn. Adjustable hydrofoils may counteract this tipping.

Accordingly, a need exists for a hydrofoil design that may be fitted to a monohull water vessel that is capable of providing sufficient stability and weight-carrying capacity (particularly when the design is scaled to hull sizes large enough to carry two or more passengers). An additional need is the ability for the hydrofoils to be retractable to allow for easy storage, transport, and shallow water navigation.

SUMMARY OF THE INVENTION

In one embodiment there is provided a trifoil lift system for a monohull sailing vessel that provides lift as well as stability to allow the vessel to travel, for example, at speeds greater than two times the wind speed.

In a particular embodiment of the present invention, the hull shape is a wedge-shaped planning surface with a wide beam for low-speed stability.

In another embodiment, the wetted surface area of the hull is preferably minimized at a fifteen degree angle of heal for sailing into the wind.

In at least one embodiment, the forward foils extend from the hull at a fifteen degree angle with respect to the vertical centerline.

In some embodiments, the foils are retractable to, for example, allow for carrying on a trailer and or shallow water operation.

Some embodiments also have foils that articulate and/or pivot about an axis to allow changes in the angle of attack.

In some embodiments, at least one hydrofoil contains winglets at the end of the planing surface to improve lift efficiency.

Some embodiments have a mast that is a rotating foil shaped section optimizing the angle of attack for the sailing rig.

In another embodiment, a motor-driven propeller provides for the vessels propulsion.

Various aspects and embodiments of the present invention, as described in more detail and by example below, address some of the shortfalls of the background technology and emerging needs in the relevant industries.

BRIEF DESCRIPTION OF THE DRAWINGS

The accompanying drawings, which are included to provide a further understanding of the invention and are incorporated in and constitute a part of this specification, illustrate exemplary embodiments of the invention that together with the description serve to explain the principles of the invention. In the drawings.

DETAILED DESCRIPTION

Figure 1:
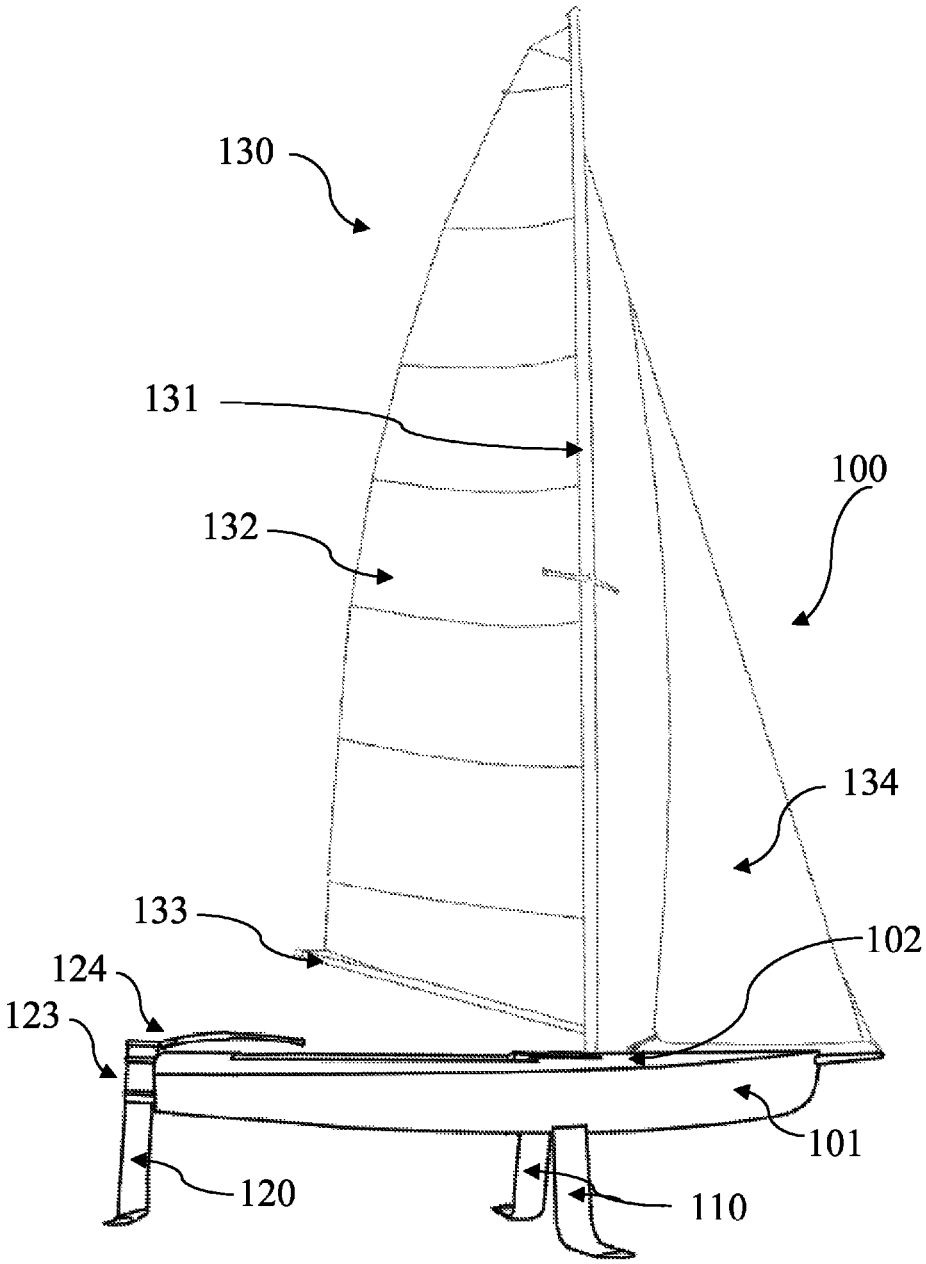
FIG. 1 is a side view of an embodiment of the present invention with the hydrofoils extended.

The present invention will now be described more fully with reference to the accompanying drawings, in which preferred embodiments of the invention are shown. The invention may, however, be embodied in many different forms and should not be construed as being limited to the embodiments set forth herein. Rather, the embodiments are provided so that this disclosure will be thorough and complete, and will fully convey the concept of the invention to those skilled in the art.

It is to be understood that the present invention is not limited to the particular methodology, compounds, materials, manufacturing techniques, uses, and applications described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures.

All patents and other publications identified are incorporated herein by reference for the purpose of describing and disclosing, for example, the methodologies described in such publications that might be used in connection with the present invention. These publications are provided solely for their disclosure prior to the filing date of the present application. Nothing in this regard should be construed as an admission that the inventor is not entitled to antedate such disclosure by virtue of prior invention or for any other reason.

Broadly described, the present invention enables a sailing vessel to travel efficiently through the water at speeds up to and greater than two times the speed of the available wind. Particular aspects of the present invention enable the efficient operation of a monohull with hydrofoils. These improvements are described in more detail below.

In one preferred embodiment, as shown in FIG. 1, a sailboat 100 having a hull 101 and a top deck 102 is shown with a sailing rig 130 having a mast 131, a main sail 132, a boom 133, and a jib sail 134. The two forward hydrofoils 110 are shown extending from the hull 101 and the rear hydrofoil 120 is shown connected to the stern of the hull 101 by pivotable sleeve 123. These hydrofoils are designed to be fully submerged. The rear hydrofoil may also serve as the rudder, with a rudder control arm 124.

In several preferred embodiments of the present invention, the main sail 132 is integrated into the mast 131 and the mast 131 is pivotable along its major axis at the point where it is attached to the top deck 102. Such a configuration may optimize the efficiency of the main sail 132 and mast 131 by, for example, more closely resembling a cambered airfoil. One skilled in the art would understand that other sails might be used including, for example, a spinnaker sail. In some preferred embodiments of the present invention, the mast 131 may have an elliptical cross section while in other preferred embodiments the cross section is symmetrically cambered having a leading edge and a trailing edge to minimize drag.

Figure 2:
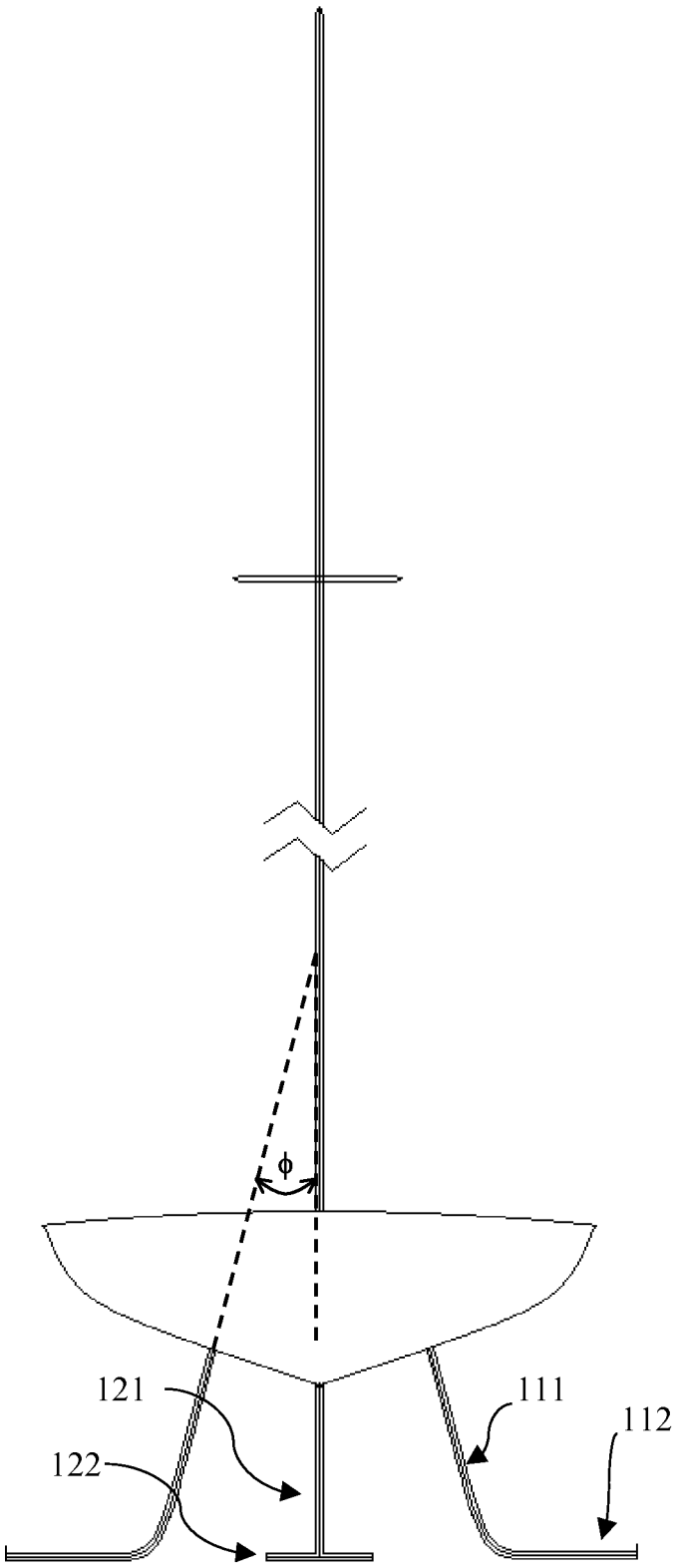
FIG. 2 is a front view of an embodiment of the present invention with the hydrofoils extended.

In another exemplary embodiment, as shown in FIG. 2, the forward hydrofoils 110 have two major sections: an extendable section 111 and a planing section 112. The rear hydrofoil 120 shown in this embodiment is an inverted T shaped hydrofoil and also has an extendable section 121 and a planing section 122. The rear hydrofoil 120 is pivotable about a vertical axis, as it may also serve as the rudder for the boat. The extendable sections of the forward hydrofoils may extend from the hull 101 at an angle $\phi$. This angle $\phi$ is preferably fifteen degrees, as measured from the vertical centerline of the vessel, but may be more or less. The planing sections 112 and 122 of the hydrofoils are preferably parallel to the surface of the water, but may be slightly angled dihedrally to supply some lateral stability. In some embodiments, the planing sections 112 and 122 of the hydrofoils may also be swept back, have raked wingtips, and/or be polyhedral, which may improve lift-to-drag efficiency as well as stability.

In a preferred embodiment, the cross section of the planning sections 112 and 122 of the hydrofoils are cambered such that an upward lift force is induced on the foil when it is traveling through the water at a zero angle of attack (a). The extendable sections 111 and 121 may also be cambered, but preferably have a symmetrical cross section such that there is no lift caused at a zero degree angle of attack. In some embodiments, at least a portion of the extendable sections of the forward hydrofoils may be asymmetrically cambered in a portion to provide some lateral stability.

Figure 3:
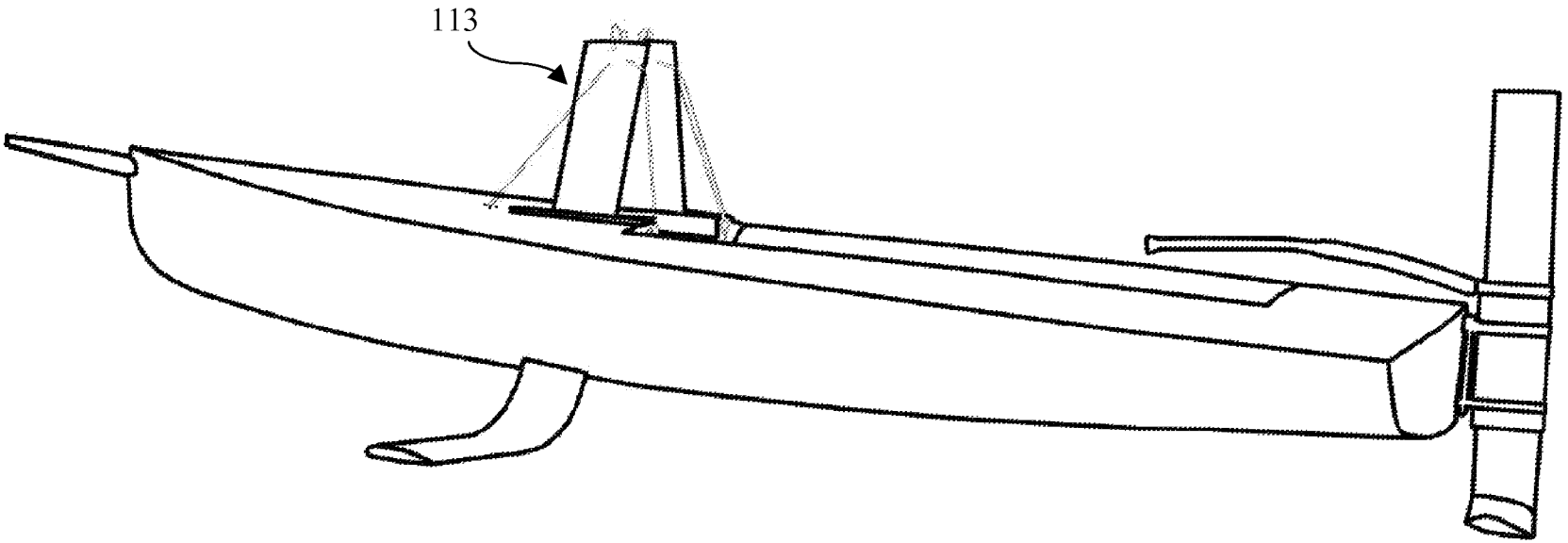
FIG. 3 is a side view of the present invention with the hydrofoils retracted.

In the preferred embodiment shown in FIG. 3, the forward and rear hydrofoils 110 and 120 are retractable and are shown in the retracted position. Having retractable foils enable the sailboat to operate in shallow water locations (not foil born) in addition to quick loading and unloading on a trailer (no disassembly needed). The embodiment shown in FIG. 3 has manually adjustable forward hydrofoils. The manual adjustments may be made by applying a force to ropes 113 affixed to the end portion of the extendable sections of the forward hydrofoils. More details of the adjustable forward hydrofoils are provided in the discussion of FIG. 5.

Figure 4:
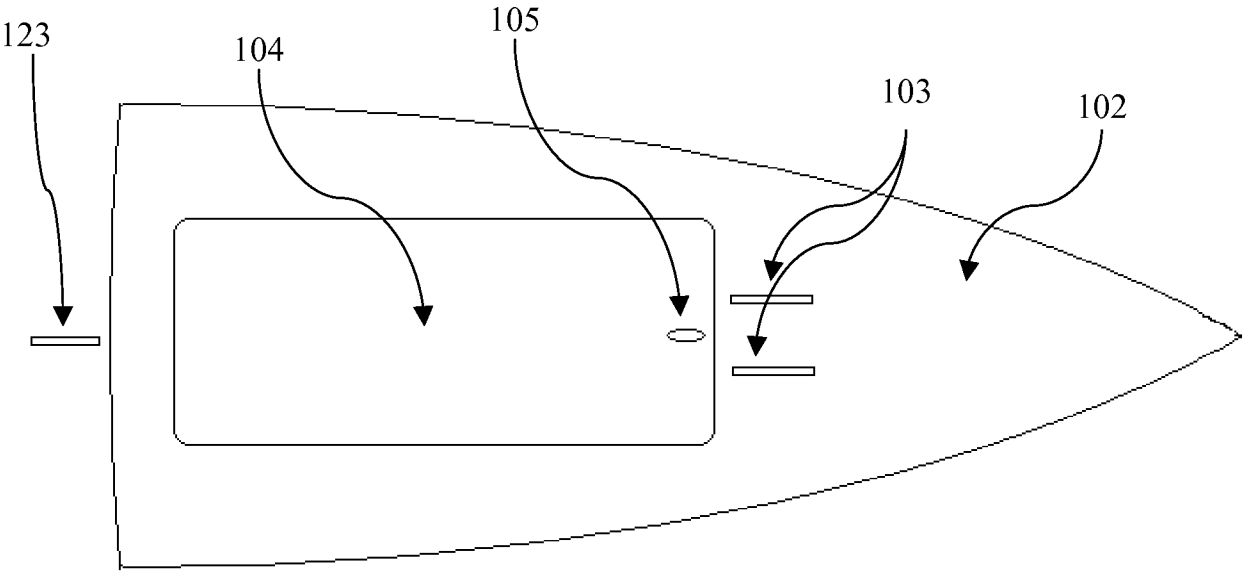
FIG. 4 is a top view of the of the present invention.

FIG. 4 shows a top view of the hull 101. From this top view, the top deck 102 and foot space 104 are seen, as well as the retracting slots 103 for receiving the extendable portion of the forward hydrofoils (not shown) the pivotable sleeve 123 for receiving the aft hydrofoil (not shown). The mast base 105 is the location where the mast is affixed to the hull. It can also be seen from this view that this preferred embodiment is configured having the forward hydrofoils positioned in front of the mast. The location of the forward foils 110 with respect to the mast base 105 and the bow varies among the different embodiments but the forward foils 110 may be more forward, the mast base 105 may be more forward, or the forward foils 110 may even be located behind the mast base 105. The top deck 102 may preferably be designed to handle the weight of its passengers walking around while under way. The foot space 104 is a recessed portion of the top deck where the passengers may more comfortably place their feet and legs while facing inward and seated on the starboard or port side of the top deck. The foot space may have handles, straps, foot stretchers, or other types of devices to help secure the passengers while sailing.

In at least one preferred embodiment, the hull is shaped with a wide, flat stern to improve stability and minimize heeling at low speeds (when the foils are not providing sufficient lift). This may allow the vessel to have less of a heel (in some embodiments, only about fifteen degrees), enabling the forces of the foil to lift the vessel out of the water vertically rather than in a lateral direction. This may also reduce (although may not completely eliminate) the need for vessel passengers to hike out so much to counteract the heeling moment. The hull design in some preferred embodiments might also have a narrow, deep-v bow that causes it to lift out of the water at low speeds. The combined wide, flat stern and narrow, deep-v bow may produce a user-friendly boat that is lifted by the foils under wind power at relatively low speeds. Other hull shapes may be used, however, particularly in embodiments where the angle of attack of the hydrofoils is independently adjustable and thereby able to offset the heeling moment.

Figure 5:
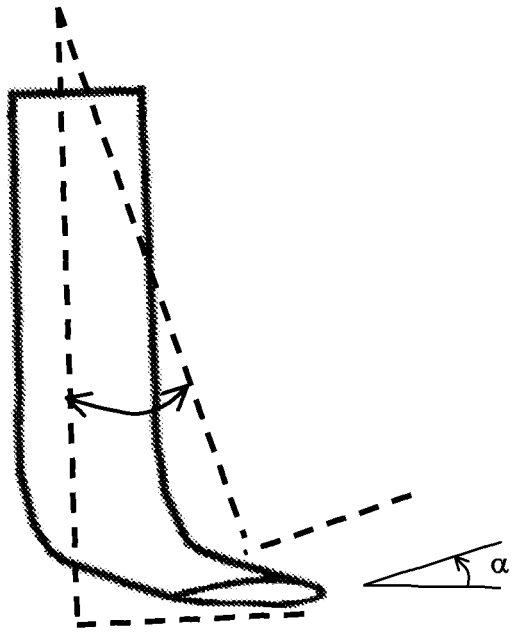
FIG. 5 is a detail view of a front hydrofoil shown in different configurations of the present invention.

Turning to the detail drawing of a forward hydrofoil in FIG. 5, it can be seen that the angle of attack (a) of the planing section of the forward hydrofoils 112 may be adjustable by pivoting the extendable portion of the foil. The pivoting of the extendable portion of the foil may be preferably performed on the top deck of the hull where these portions of the foil extend, as shown in FIG. 3. Each of the planing sections of the forward hydrofoils 112 may preferably be independently adjustable. Having the angle of attack of the planing sections independently adjustable may enable each foil to provide different amounts of lift. As a result, for example, the heeling moment caused by the wind blowing against the sail may be countered by increasing the angle of attack on the leeward side forward hydrofoil while decreasing the angle of attack on the windward side forward hydrofoil. Moreover, when the trifoiler is moving through the water but not yet foil-born, a brief increase in the angle of attack of both forward foils may bring the hull out of the water sufficiently to sustain foil-born operation. Such adjustments may be, for example, performed manually with ropes and pulleys operated by hand or automatically through servo motors, hydraulics, or active surfaces and linkages, or a combination of manual and automatic operating modes.

Figure 6:
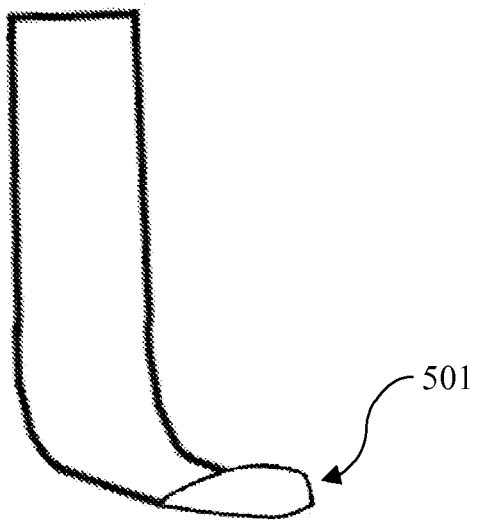
FIG. 6 is a detail view of the front hydrofoil in another embodiment of the present invention.
Figure 7:
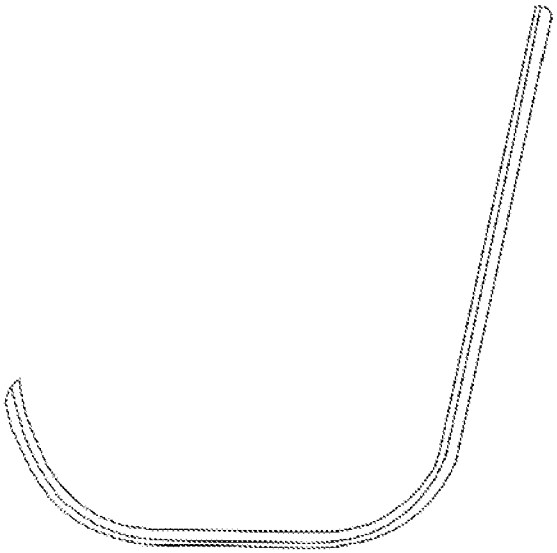
FIG. 7 is a detail view of the front hydrofoil in yet another embodiment of the present invention.

In some embodiments, the end of the planing portions may have winglets 501, as is shown in FIG. 6, or other wingtip devices commonly employed in aviation design. Wingtip devices may improve the operating efficiency of the hydrofoils by maintaining laminar flow at the end portion of the planing surface, avoiding wingtip vortex. Other embodiments have the end portion of the planing section extending upward, as illustrated in FIG. 7, which may serve similar functions as the wingtip devices. Trials suggest that a narrow planing section tapered and sculpted up at the end will maintain the lift and decrease the drag caused by tip vortices. Such gains in efficiency may allow for greater speeds of the vessel and even perhaps it attaining three times the wind speed.

Figure 8A:
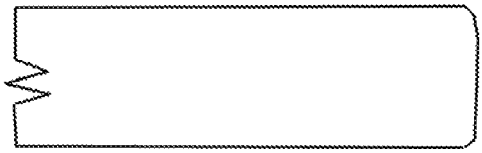
FIGS. 8*a*, 8*b*, 8*c*, 8*d*, 8*e*, and 8*f* are plan views of various embodiments of the end-sections of the hydrofoils of the present invention.
Figure 8B:
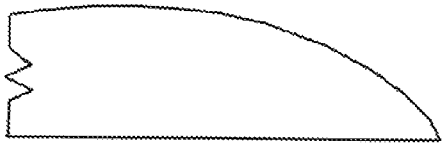
Figure 8C:
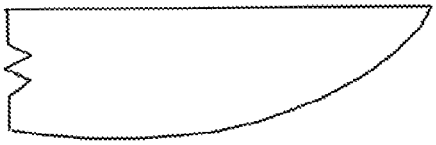
Figure 8D:
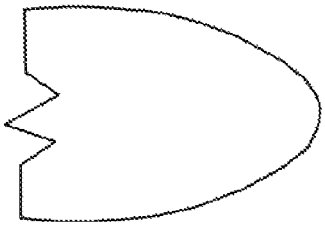
Figure 8E:
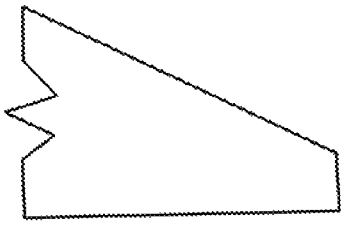
Figure 8F:
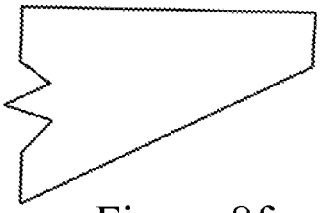

Examples of different cambered foil tip designs are illustrated in FIGS. 8*a*, 8*b*, 8*c*, 8*d*, 8*e*, and 8*f* and may be implemented to improve performance in different conditions, such as wind speeds and sailing vessel weights. Each of these tip designs may be substantially parallel to the planing section of the hydrofoil or may preferably be extended at an angle upward so as to capture the water falling off the tip of the hydrofoil and causing the tip vortex drag, similar to the illustration in FIG. 7. FIG. 8*a* shows a square foil tip design where the planing section of the foil is bluntly terminated. FIG. 8*b* illustrates a foil tip design where the aft edge is tapered while FIG. 8*c* illustrates a foil tip design where the forward edge is tapered. FIG. 8*d* is an elliptical tip foil, where both the forward and aft edges are tapered. FIG. 8*e* illustrates a foil tip design where the aft edge is tapered to a flat tip while FIG. 8*f* illustrates a foil tip design where the forward edge is tapered to a flat tip.

The hydrofoils are preferably made of rigid and durable material such as, for example, extruded aluminum alloy, steel, carbon fiber, fiberglass, or wood.

In some embodiments of the present invention, the planing sections and the extendable sections of the hydrofoils may be separate components and pivotably attached to one another. In such a configuration, the angle of attack of the planing sections may be adjusted by linkage, cables, hydraulics, or other means housed within the extendable section.

The operation of the sailboat begins by placing the vessel into the water. As mentioned above, some preferred embodiments have retractable hydrofoils, which enable it to be easily transported by a trailer. Once the sailboat is in the water that is sufficiently deep, the hydrofoils may be extended. With the main sail and jib sail trimmed, the sailboat will begin to travel in the forward direction, similar to any traditional sailboat. Increasing the angle of attack on the leeward forward hydrofoil (or decreasing the angle of attack on the windward forward hydrofoil) may be done to minimize the heeling of the hull. Once a certain amount of speed is attained, the angle of attack on the forward hydrofoils may be abruptly increased such that the hull is lifted out of the water from the momentum. Once lifted, the forward hydrofoils may lessen their angle of attack, and preferably having the leeward hydrofoil with an angle greater than the windward angle to counter any heeling moment.

The embodiments described above are exemplary only. One skilled in the art may recognize variations from the embodiments specifically described here, which are intended to be within the scope of this disclosure. As such, the invention is limited only by the following claims. Thus, it is intended that the present invention cover the modifications of this invention provided they come within the scope of the appended claims and their equivalents. Further, specific explanations or theories regarding the design of hydrofoils according to the present invention are presented for explanation only and are not to be considered limiting with respect to the scope of the present disclosure or the claims.

What is claimed is:

1. A sailing monohull trifoiler comprising:

a hull;

a mast extending vertically from the hull, an aft hydrofoil; and two forward hydrofoils, each extending from the hull along a line extending at an angle Φ from a vertical centerline extending from the hull, each forward hydrofoil comprising:

an extendable section having a retracted position in which the extendable section is disposed inward of the hull and an extended position in which extendable section is adapted to extend outward from the hull, the extendable section also adapted to be pivotable about a point on the line extending at angle Φ; and a planning section rigidly connected to one end of the extendable section, whereby the angle of attack α of the planning section is changed as a result of the pivoting of the extendable section.

2. The sailing monohull trifoiler of claim 1, wherein the angle of attack α of the planing sections of each of the two forward hydrofoils are independently adjustable when in the extended position.

3. The sailing monohull trifoiler of claim 1, wherein the two forward hydrofoils extend along a line extending from the mast at an angle of 15 degrees.

4. The sailing monohull trifoiler of claim 1, wherein the planing sections of each of the two forward hydrofoils are cambered and have cross-sections where the camber of the upper surface is substantially greater than the camber of the lower surface.

5. The sailing monohull trifoiler of claim 1, further comprising winglets affixed to the ends of the respective planing sections of each of the two forward hydrofoils.

6. The sailing monohull trifoiler of claim 1, wherein the planning sections of each of the two forward hydrofoils are oriented substantially parallel to the surface of the water.

7. The sailing monohull trifoiler of claim 1, wherein the planning sections of each of the two forward hydrofoils extend upward at an end portion opposite of the extendable section.

8. The sailing monohull trifoiler of claim 1 being capable of carrying at least two adults while the sailing monohull trifoiler is foil-born.

9. A sailboat comprising:

a hull, a sailing rig affixed to the top side of the hull, the sailing rig comprising a mast;

a starboard foil extending through the starboard side of the hull along a line extending in the starboard direction at an angle Φ from a vertical centerline extending from the hull, the foil having an extendable section and a planing section, the extendable section being extendable from within the hull and pivotable about a point on the line extending at angle Φ;

a port foil extending through the port side of the hull along a line extending in the port direction at angle Φ from a vertical centerline extending from the hull, the foil having an extendable section and a planing section, the extendable section being extendable from within the hull and pivotable about a point on the line extending at angle Φ; and an aft foil pivotably connected to the stern of the hull.

10. The sailboat of claim 9, wherein the angle of attack of the planing sections of the starboard foil and the port foil are independently adjustable.

11. The sailboat of claim 9, wherein the sailing rig further comprising at least one mast, at least one sail, and at least one boom.

* * * * *